US010113548B2

(12) United States Patent
Rapp et al.

(10) Patent No.: US 10,113,548 B2
(45) Date of Patent: Oct. 30, 2018

(54) COMBINATION OF MOTOR AND VACUUM PUMP WITH AN EXHAUST FLOW

(71) Applicant: Gebr. Becker GmbH, Wuppertal (DE)

(72) Inventors: Michael Rapp, Solingen (DE); Denko Popovac, Cologne (DE); Rudolf Bahnen, Roetgen (DE)

(73) Assignee: Gebr. Becker GmbH, Wuppertal (DE)

( * ) Notice: Subject to any disclaimer, the term of this patent is extended or adjusted under 35 U.S.C. 154(b) by 73 days.

(21) Appl. No.: 15/333,432

(22) Filed: Oct. 25, 2016

(65) Prior Publication Data

US 2018/0112667 A1 Apr. 26, 2018

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 29/12*** | (2006.01) |
| ***F04C 18/344*** | (2006.01) |
| ***F04C 29/00*** | (2006.01) |
| ***F04C 25/02*** | (2006.01) |

(52) U.S. Cl.

CPC ..... *F04C 29/124* (2013.01); *F04C 18/344* (2013.01); *F04C 25/02* (2013.01); *F04C 29/0085* (2013.01); *F04C 2270/12* (2013.01)

(58) Field of Classification Search

CPC .. F04C 23/008; F04C 29/0085; F04C 29/124; F04C 29/126; F04C 18/344; F04C 2/344; F04C 25/02; F04C 2270/72; F04C 2270/12

USPC ..... 418/15, 152, 259, 270

See application file for complete search history.

(56) References Cited

U.S. PATENT DOCUMENTS

| | | | | |
|---|---|---|---|---|
| 3,788,770 A * | 1/1974 | Johnson | F04C 14/02 417/62 |
| 4,523,897 A * | 6/1985 | Lower | F04C 23/001 418/269 |
| 4,631,006 A * | 12/1986 | Murray | F04C 23/008 418/270 |
| 5,100,308 A | 3/1992 | Gevelhoff et al. | |

FOREIGN PATENT DOCUMENTS

| | | |
|---|---|---|
| DE | 89 08 757 U1 | 9/1989 |
| DE | 44 246 29 C1 | 3/1995 |
| DE | 198 18 667 A1 | 10/1999 |
| DE | 101 06 111 A1 | 8/2002 |
| DE | 03 305 41 A1 | 2/2005 |

* cited by examiner

*Primary Examiner* — Theresa Trieu

(74) *Attorney, Agent, or Firm* — Collard & Roe, P.C.

(57) ABSTRACT

A vacuum pump generates a vacuum, in a suction device, with an air intake device and an air exhaust device, as well as a motor for driving the vacuum pump. The air exhaust device is provided with a discharge valve. The exhaust air is downstream of the discharge valve divided into two partial flows that are respectively associated with a pipe section.

11 Claims, 11 Drawing Sheets

25
20
20
26
19
16
14
13
23
24
21
7
15
22
27
35
28
35
33
31
36
31
33
34
36
34

COMBINATION OF MOTOR AND VACUUM PUMP WITH AN EXHAUST FLOW

TECHNICAL FIELD

The invention pertains to a vacuum pump, e.g. a rotary vane vacuum pump, for generating a vacuum, e.g. in a suction device, with an air intake device and an air exhaust device, as well as a motor for driving the vacuum pump, wherein the air exhaust device is provided with a discharge valve.

PRIOR ART

Vacuum pumps of the type in question are generally known, e.g. in the form of rotary vane vacuum pumps, as well as in the form of so-called side channel compressors.

Rotary vane vacuum pumps usually consist of a blower with a rotary vane housing that forms a rotary vane chamber realized in the form of a cylindrical bore. The rotary vane rotor is usually realized cylindrically and features vanes that are displaceably arranged in slots of the rotor. Referred to a cross section through the rotor, the slots in the rotor may be strictly aligned radially or include an acute angle with a radial line. According to the prior art, the rotor is preferably supported in the region of the cover or flange, e.g. a motor flange, that respectively forms the termination of the rotary vane housing.

During the operation of the vacuum pump, the rotor rotates radially offset to the center axis of the rotary vane housing. This results in the formation of closed chambers that are separated by the vanes, which essentially can be displaced radially, wherein the size of these closed chambers varies during one revolution of the rotor. These size variations cause pressure differentials between the individual chambers and therefore between the air intake device and the air exhaust device of the pump.

Rotary vane vacuum pumps are known, e.g., from DE 101 06 111 A1, as well as from DE 103 30 541 A1 or from DE 89 08 757 U1 (U.S. Pat. No. 5,100,308 A). Vacuum pumps in the form of side channel compressors are known, e.g., from DE 198 18 667 A1 or from DE 44 24 629 C1.

It is furthermore known to provide the outlet side of the pump with a discharge valve, behind which the exhaust air can be discharged into the surroundings if the vacuum pump is realized in the form of a suction device.

SUMMARY OF THE INVENTION

In light of the above-described prior art, the invention is based on the objective of enhancing a vacuum pump of the type in question, particularly with respect to an improved noise emission during the operation of the pump.

According to a first aspect of the invention, the above-defined objective can be attained with a vacuum pump, which is designed such that the exhaust air is downstream of the discharge valve divided into two partial flows that are respectively associated with a pipe section.

According to another aspect of the invention, the above-defined objective can also be attained with a vacuum pump, which is designed such that the discharge valve is arranged above the motor and the vacuum pump referred to a normal operating state of the combination of motor and vacuum pump and that a pipe section, which conveys the exhaust air from the region above the motor and the vacuum pump into a region underneath the motor and the vacuum pump, is connected to the discharge valve, wherein the pipe section is partially or completely arranged within the outside contour of the motor and/or the vacuum pump referred to a cross section perpendicular to a longitudinal axis of the motor and/or pump shaft.

Each individual solution, as well as any possible combination of the individual characteristics, results in a significant reduction of the noise mission in comparison with pumps according to the above-describe the prior art.

In a potential embodiment, the exhaust air may therefore be conveyed through two pipe sections downstream of the discharge valve. For this purpose, a corresponding branch may be provided downstream of the discharge valve referred to the flow direction, if applicable directly downstream of the discharge valve or at a certain distance from the discharge valve. The branch may furthermore be realized within the valve housing containing the discharge valve such that partial flows are directly discharged from the valve housing. The branch particularly may be realized in the form of a bifurcated pipe that is arranged directly adjacent to the discharge valve referred to the flow direction.

In this context, it is furthermore conceivable that the partial flows—and accordingly the corresponding pipe sections—are dimensioned identically, e.g., with respect to the cross-sectional area of the pipe sections viewed transverse to the flow direction and/or the length of the pipe sections viewed in the flow direction. However, different dimensions may also be provided in this respect.

An (additional) noise reduction can be achieved by conveying the exhaust air from the upper region of the vacuum pump, in which the discharge valve is usually arranged, into a lower region that particularly is directed downward in the operating state. Such a vacuum pump can be used, e.g., in medical-technical devices. Since the exhaust air is now discharged underneath the region of the motor and the vacuum pump, it is directed away, in particular, from persons located in the vicinity during the normal operation of the entire device.

A spatially advantageous solution is achieved due to the proposed arrangement of the pipe section within the cross-sectional outside contour of the motor and/or the vacuum pump. Due to this design, the shift of the air outlet from the top to the bottom only adds little or nothing at all to the cross-sectional dimension of the vacuum pump and/or the motor.

If the exhaust air is divided into two partial flows that are respectively associated with a pipe section, both pipe sections preferably can at least essentially extend within the outside contour of the motor and/or the vacuum pump in order to advantageously convey the exhaust air from an upper region into a region underneath the motor and the vacuum pump.

Other characteristics of the invention are frequently explained below, as well as in the description of the figures, in their preferred association with the device and features described herein. However, they may respectively also be important in association with only individual characteristics of the device or other features described herein.

In an enhancement, a pipe section for a partial flow may feature a discharge opening into the surroundings and the discharge opening into the surroundings may respectively be provided with a check valve or discharge valve. The discharge opening into the surroundings can preferably be realized underneath the motor and the vacuum pump. Due to the potential arrangement of an (additional) discharge valve in the region of the discharge opening into the surroundings, valves may in a potential embodiment be provided on both ends of a pipe section arranged downstream of the air exhaust device.

If two pipe sections are provided, each pipe section forms a discharge opening into the surroundings that may be respectively provided with an (additional) discharge valve.

The motor may be realized in the form of an electric motor. This electric motor preferably features a motor flange. The pipe section may be integrated into the motor flange. It is preferred to provide the motor flange formed between the motor and the vacuum pump with the pipe section.

If two pipe sections are provided, both pipe sections may in a potential embodiment be integrated into the motor flange.

In another embodiment, the pipe section may be composed of a partial section in the motor flange and a partial section outside the motor flange. The partial section outside the motor flange may particularly extend between the discharge valve and the partial section in the motor flange. The partial pipe section in the motor flange can preferably feature the discharge opening into the surroundings that, if applicable, is provided with an (additional) discharge valve.

The motor flange may consist of a metallic material. Such a motor flange can be manufactured, e.g., in a sand casting process. The pipe section, particularly the corresponding partial section if another partial section is provided outside the motor flange, may be formed by the metallic material of the motor flange. Accordingly, the pipe section on the flange side is in a preferred embodiment directly formed by the flange material.

The pipe section integrated into the motor flange may particularly extend along a segment of a circle referred to the cross section perpendicular to the longitudinal axis of the motor and/or pump shaft in order to convey the exhaust air from a region above the motor and the vacuum pump into a region underneath the motor and the vacuum pump. The integrated pipe section may furthermore be defined in the form of a segment of a circle, the center of which is associated with the geometric axis of the motor and/or pump shaft.

If two pipe sections are integrated into the motor flange, these pipe sections may in a potential embodiment respectively extend along a segment of a circle such that they essentially are arranged diametrically opposite of one another referred to the shaft axis.

The combination of motor and vacuum pump may be mounted on a base plate that is supported by means of legs. In this way, a unit consisting of the motor and the vacuum pump including the pipe sections within the motor flange can be realized.

The discharge opening of the pipe section may lead into the surroundings underneath the base plate referred to a normal operating state of the combination. In a potential embodiment, the pipe sections or sections connected to these pipe sections such as, e.g., the check or discharge valves may extend through the base plate. The opening plane of the discharge opening preferably extends underneath the base plate at a certain distance from the facing bottom surface of the base plate, wherein said distance may be chosen smaller than twice the largest cross-sectional inside dimension of the pipe section, preferably equal to or smaller than this largest cross-sectional inside dimension of the pipe section.

In a preferred embodiment, in which the base plate is supported on a floor or the like by means of legs, the discharge opening or the discharge openings may respectively lead into the intermediate space resulting from the height of the legs.

The base plate may be supported by means of vibration-cushioned legs. In this way, an additional noise reduction of the entire combination is achieved.

A vibration-cushioned leg may feature an elastomer or rubber part that, e.g., is penetrated by a mounting screw or features a mounting pin, which respectively connects the leg to the base plate.

BRIEF DESCRIPTION OF THE DRAWINGS

The invention is described in greater detail below with reference to the attached drawings that merely show an exemplary embodiment. In these drawings:

FIG. 7 shows a perspective bottom view the combination according to FIG. 1 mounted on a base plate;

DESCRIPTION OF THE EMBODIMENTS

Figure 1:
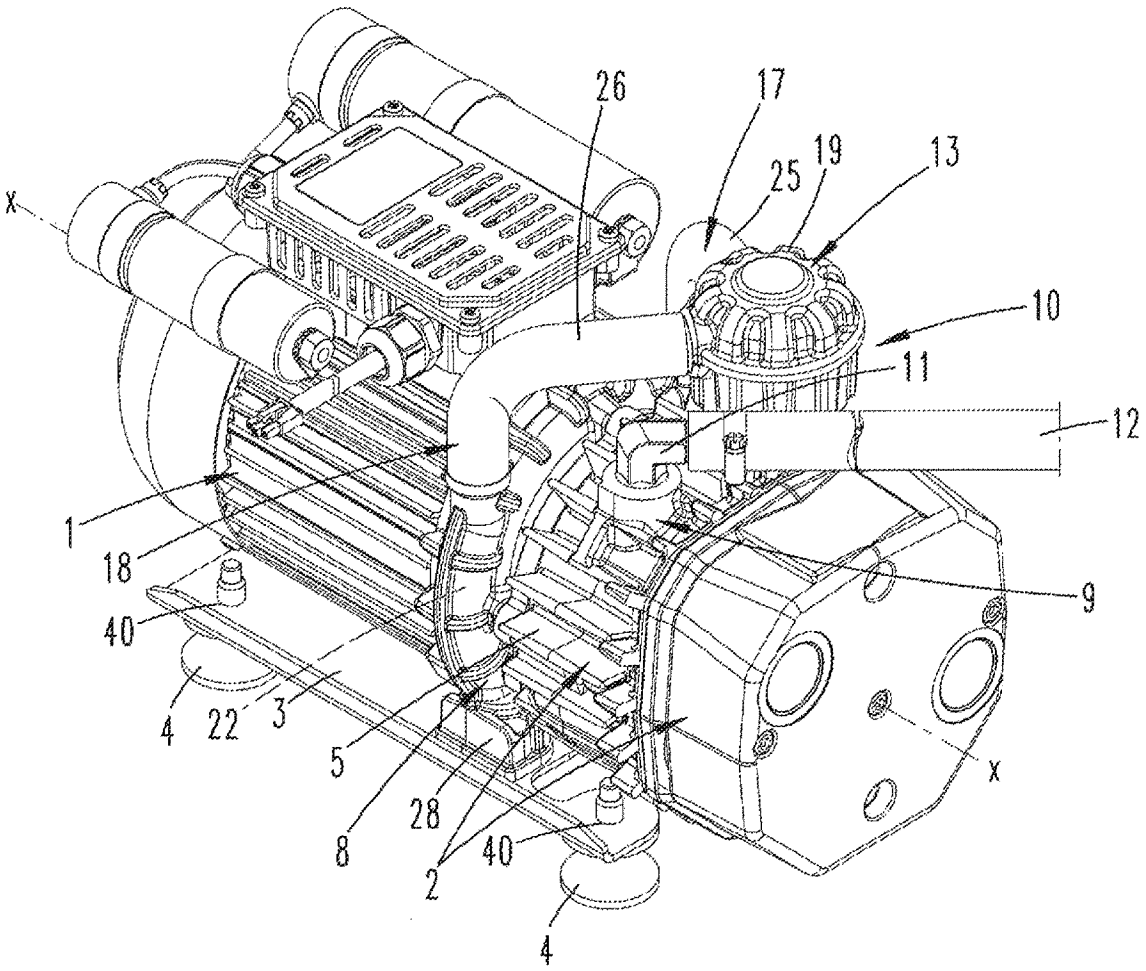
FIG. 1 shows a perspective view of a combination of motor and vacuum pump that is mounted on a base plate supported by legs.
Figure 1A:
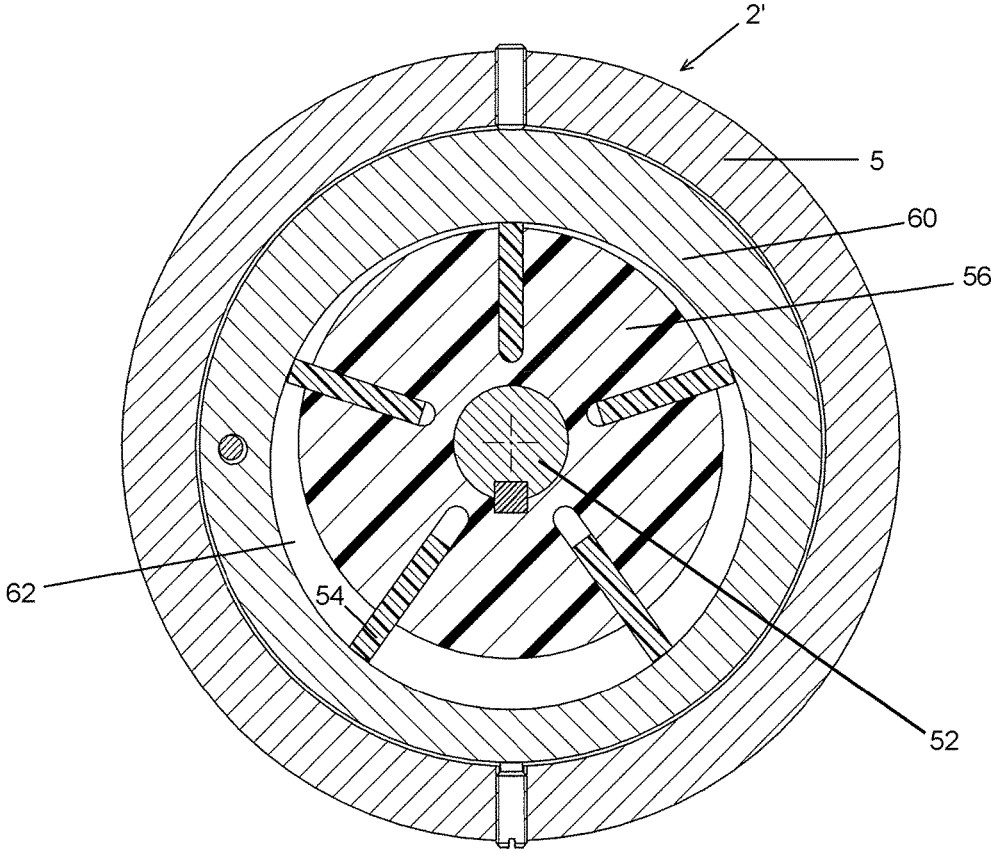
FIG. 1*a* shows a cross-sectional view through a rotary vane vacuum pump in one embodiment of the combination.
Figure 2:
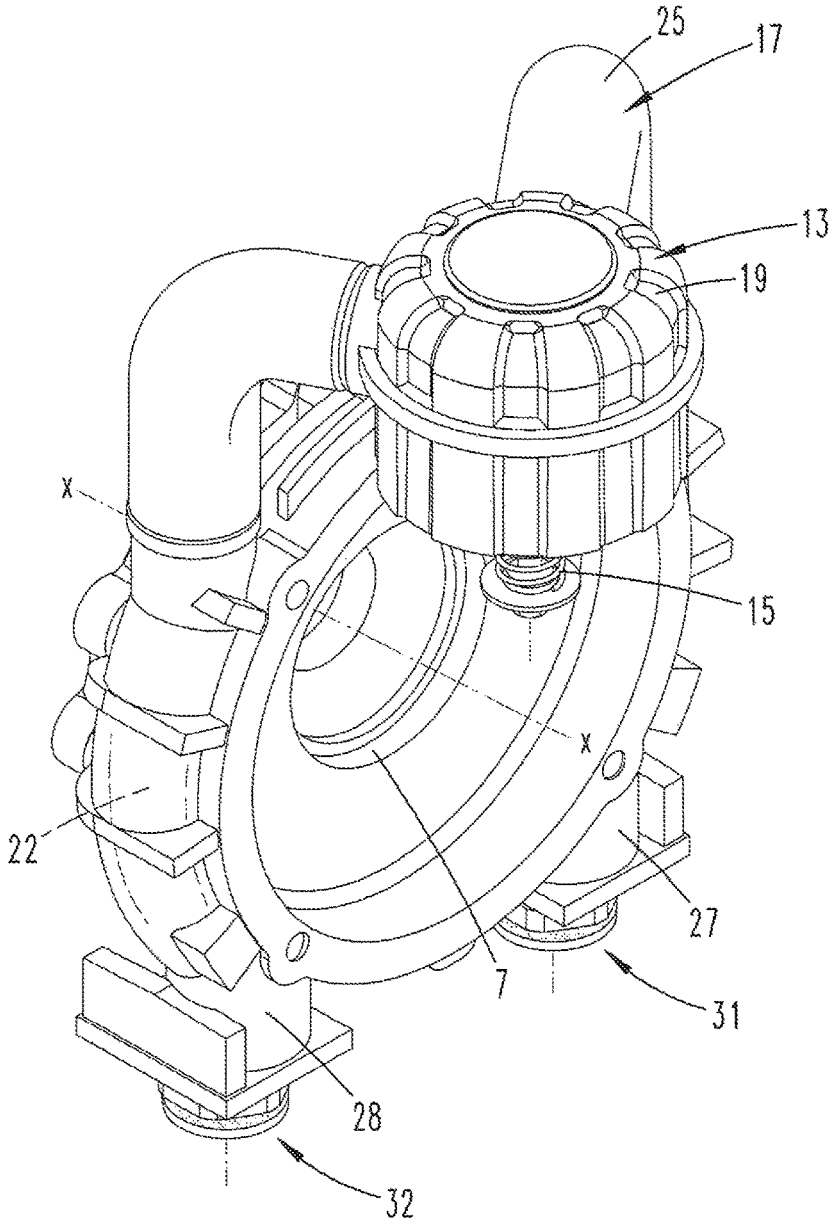
FIG. 2 shows an individual perspective view of a motor flange that can be arranged between the motor and the vacuum pump and features pipe sections, as well as three discharge valves.
Figure 3:
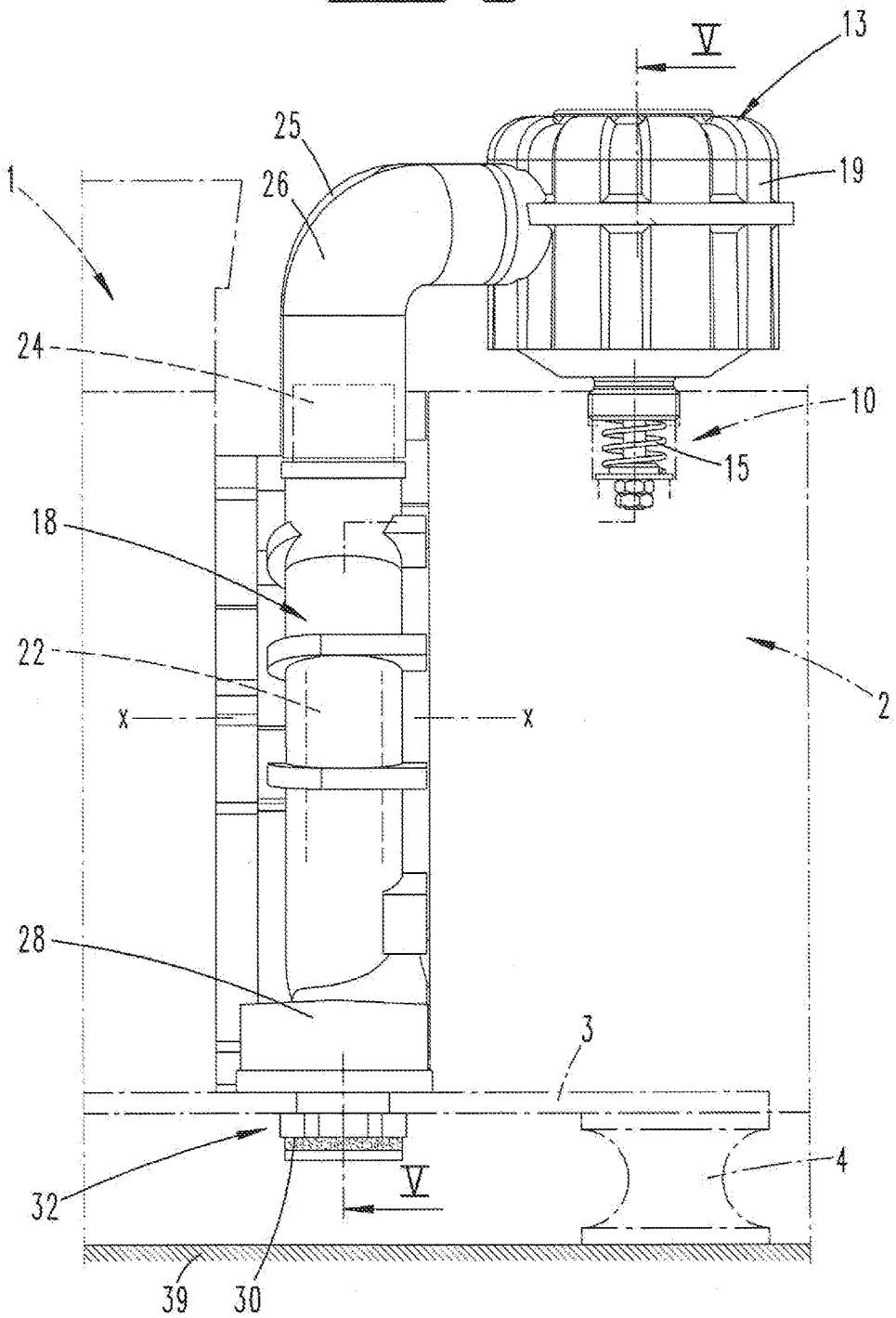
FIG. 3 shows a side view of the motor flange according to FIG. 2, in which the installation position is illustrated with dot-dash lines.
Figure 4:
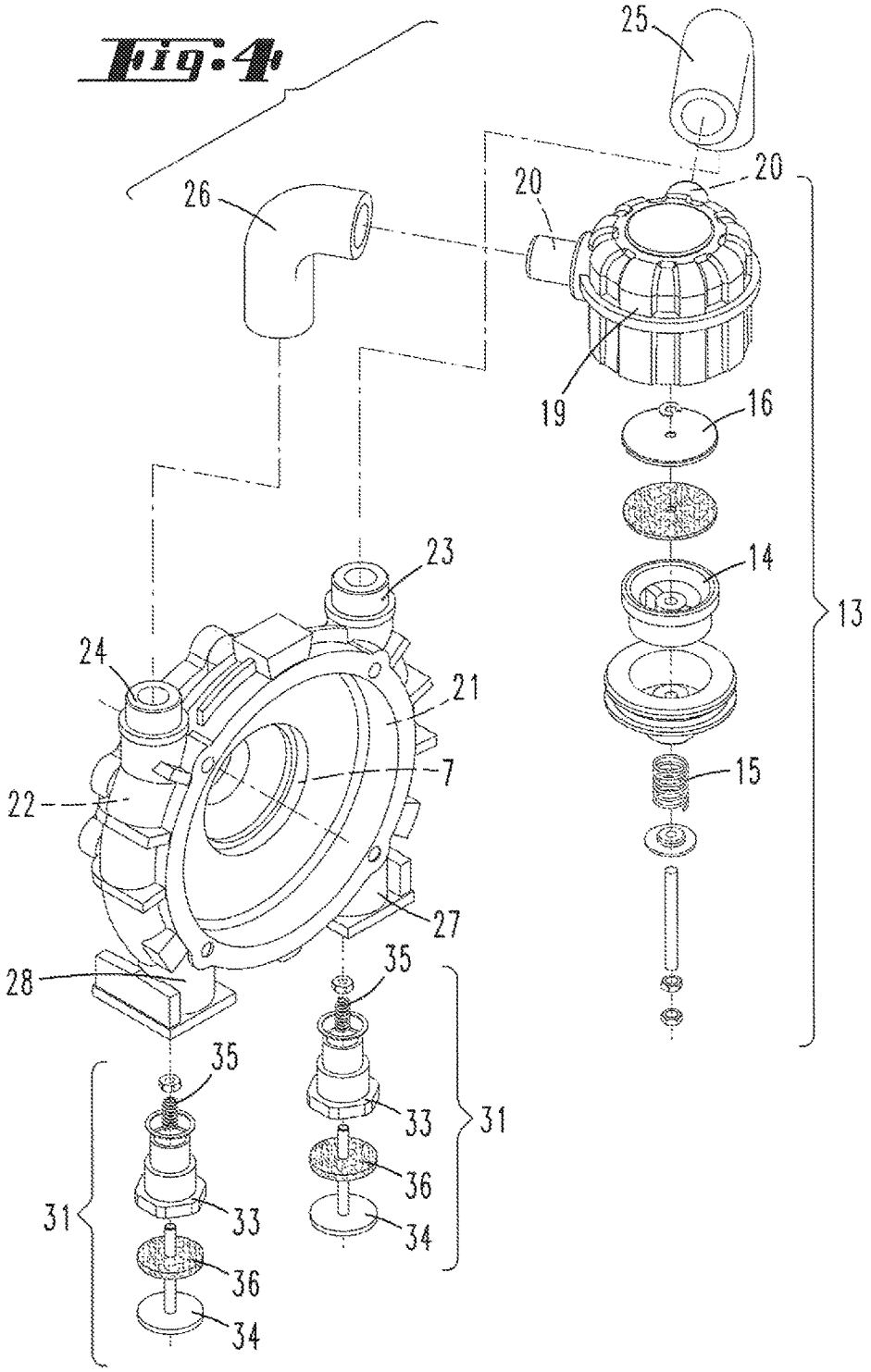
FIG. 4 shows the motor flange with the line sections and the discharge valves in the form of a perspective exploded view.

A combination of a motor 1, particularly an electric motor, and a vacuum pump 2, preferably a rotary vane vacuum pump 2' (as shown in FIG. 1*a*), is initially described with reference to FIG. 1. In the exemplary embodiment shown, this combination is mounted on a base plate 3 that is supported on the ground by means of legs 4.

The vacuum pump 2 features a pump housing 5, in which a rotary vane chamber 62 with a rotary vane rotor 56 is arranged. Within the pump housing 5 is a chamber housing 60. With respect to the design and function of the vacuum pump 2, we refer to the initially cited literature, e.g. to DE 101 06 111 A1. The content of this patent application is hereby fully incorporated into the disclosure of the present invention, namely also for the purpose of incorporating characteristics of this patent application into claims of the present invention. FIG. 1*a* shows an embodiment in which the vacuum pump 2 is a rotary vane vacuum pump 2'.

During the operation of the vacuum pump 2, the rotary vane rotor 56 rotates radially offset to the geometric axis x of a motor shaft 6. The rotary drive is realized by means of the motor 1 that rotatively acts upon the pump shaft 52. The motor shaft 6 of said motor longitudinally penetrates a central opening 7 of a motor flange 8 arranged between the motor 1 and the vacuum pump 2.

Figure 5:
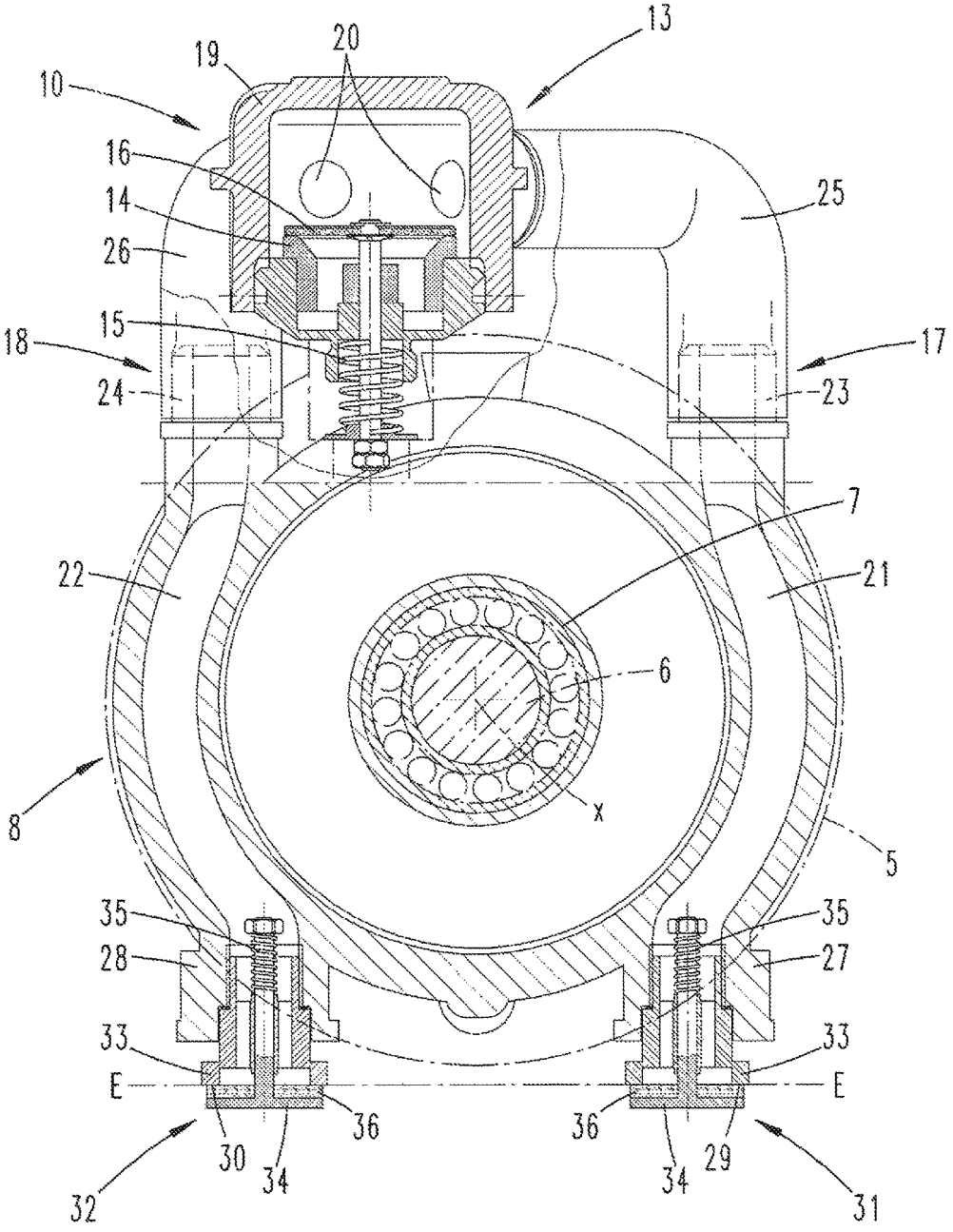
FIG. 5 shows the section along the line V-V in FIG. 3.

The opening 7 of the motor flange 8 may simultaneously serve for supporting the motor shaft 6 (see FIG. 5).

The vacuum pump 2 features an air intake device 9 and an air exhaust device 10 associated with the rotary vane chamber 62.

The air intake device 9 may feature a connecting piece 11. This connecting piece produces the fluidic connection with the rotary vane chamber 62. A suction hose 12, e.g. of a rubber material, may be connected to the connecting piece 11 as indicated.

The air exhaust device 10 is also fluidically connected to the rotary vane chamber 62.

Both thusly formed air intake and exhaust openings of the vacuum pump are positioned above the motor 1 and the vacuum pump 2 during the normal operation of the vacuum pump 2, particularly the normal operation of the aforementioned combination. Accordingly, the suction hose 12 of the air intake device 9 also extends above the vacuum pump 2.

A discharge valve 13 is provided in the region of the air discharge opening of the pump housing 5. This valve may consist of a check valve with a valve seat 14 and a valve disk 16 that is spring-loaded into a closed valve position by means of a spring 15. In a normal position according to FIG. 5, this valve disk is seated on the valve seat 14 in a sealed fashion. The valve disk 16 is only raised into an open position according to FIG. 6 when a pressure greater than the restoring force of the spring 15 is exceeded.

Figure 6:
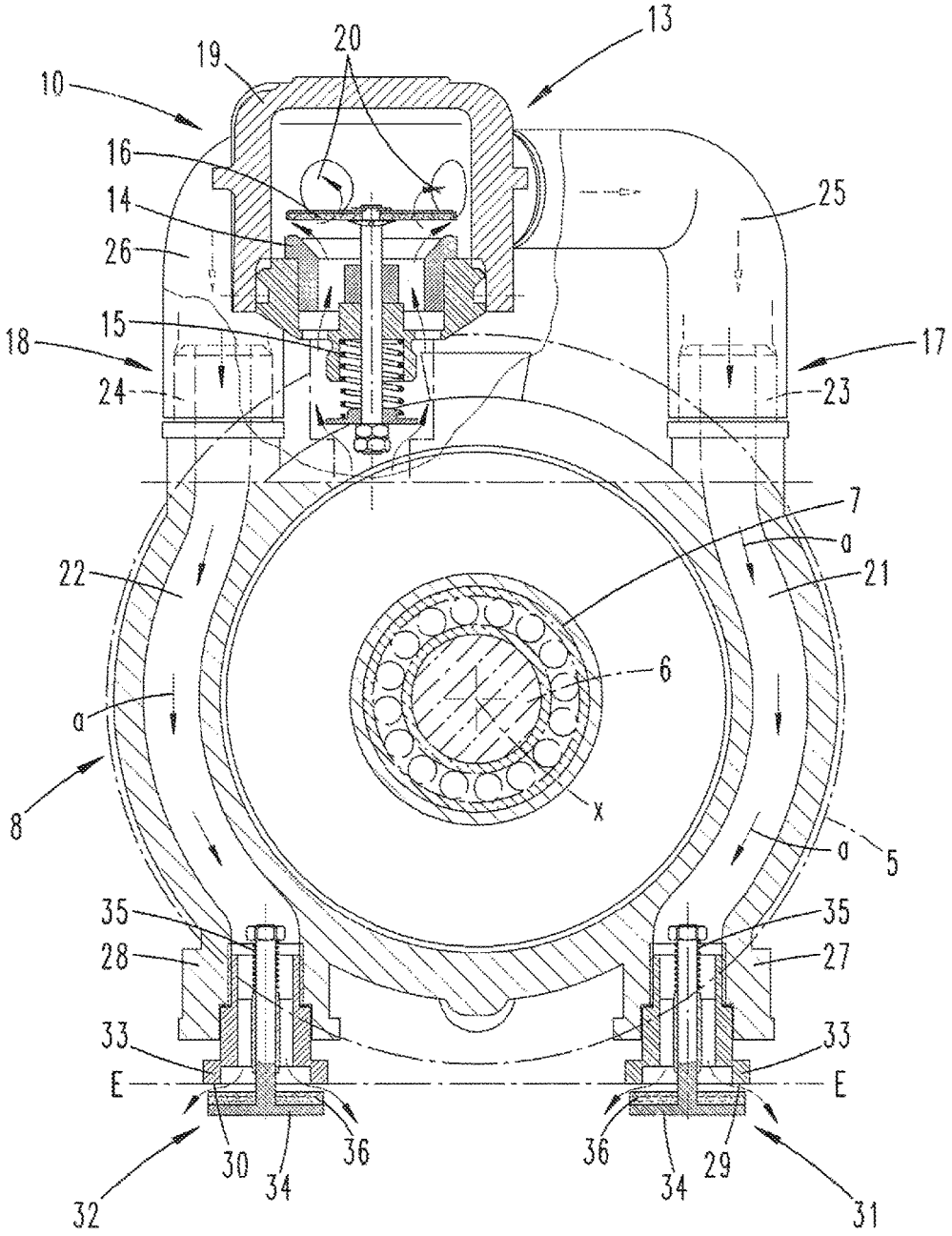
FIG. 6 shows an illustration corresponding to FIG. 5 during the operation of the vacuum pump.
Figure 1:
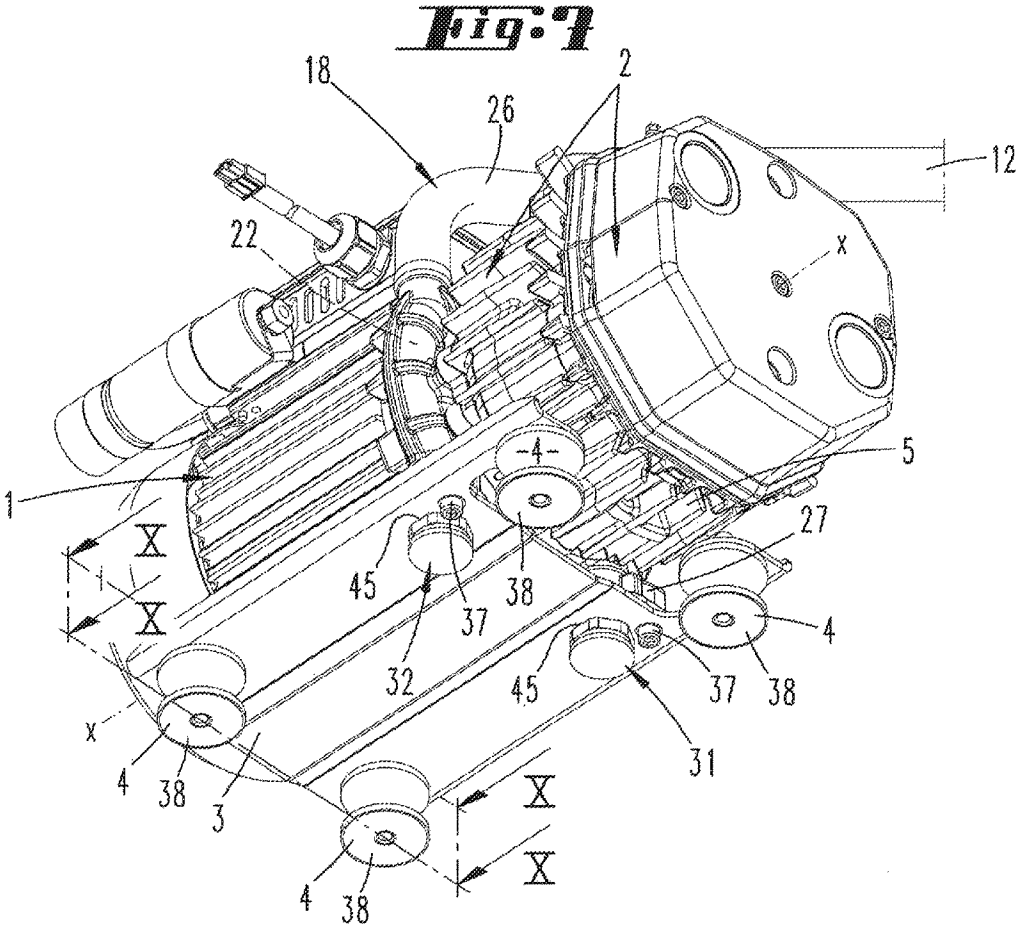

The exhaust air is divided into two partial flows in the flow direction (see arrows a in FIG. 6). For this purpose, two pipe sections 17 and 18 are arranged downstream of the discharge valve 13. The valve cover 19 that bridges the cooperating region of the valve seat 14 and the valve disk 16 may feature corresponding connecting pieces for connecting the pipe sections 17 and 18. The valve cover wall is provided with correspondingly positioned discharge openings 20.

The pipe sections 17 and 18 convey the partial flows from the region above the motor 1 and the vacuum pump 2 into a region underneath the motor 1 and/or the vacuum pump 2 (see FIG. 5).

Each pipe section 17, 18 may be composed of two partial sections that are arranged behind one another in the flow direction as shown. A rigid partial section 21, 22, which is integrated into the motor flange 8, is thereby respectively provided.

The motor flange 8 may accordingly serve for terminating the motor 1 on its end face and, if applicable, for supporting the motor shaft 6, as well as for conveying the air flow from the discharge valve 13 arranged on the upper side of the vacuum pump 2 into a region underneath the motor 1 and/or the vacuum pump 2.

Referred to a cross section transverse to the axis x according to FIG. 5, the motor flange 8 consisting of a metallic material, which is manufactured, e.g., in a sand casting process, accordingly features two partial sections 21, 22 of the pipe sections 17, 18, wherein said partial sections respectively extend along a segment of a circle, the center of which is associated with the geometric axis x, such that they lie diametrically opposite of one another referred to the axis x.

The two partial sections 21 and 22 end in connecting pieces 23, 24 on the upper side of the motor flange 8 facing the discharge valve 13. Hose pipes 25 and 26 that respectively form first partial sections are arranged on these connecting pieces in a fluidically tight fashion. On their ends that face away from the partial sections 21 and 22, these hose pipes are fixed on the valve cover 19 in association with the discharge openings 20.

A hose pipe 25 or 26 respectively forms one of the pipe sections 17 or 18 together with the corresponding partial section 21 or 22 on the flange side.

On the underside of the motor flange 8, the partial sections 21 and 22 of the pipe sections 17 and 18 on the flange side end in downwardly open connecting pieces 27, 28. The latter respectively form discharge openings 29, 30 into the surroundings, which are respectively provided with an additional discharge valve 31, 32.

Each discharge valve 31, 32 features a housing with a valve seat 33. This housing can be fixed in the associated connecting piece 27, 28, e.g., by means of a screw joint as shown.

A valve disk 34 is also guided in the housing and acts against the valve seat 33 in a sealing fashion in order to close the discharge opening 29. The valve disk 34 is spring-loaded into this valve seat position by means of a spring 35, e.g. a cylindrical pressure spring.

The valve disk 34 may furthermore cooperate with the valve seat 33 via a sealing layer 36 as shown. The sealing layer 36 may consist, e.g., of a felt layer.

Figure 9:
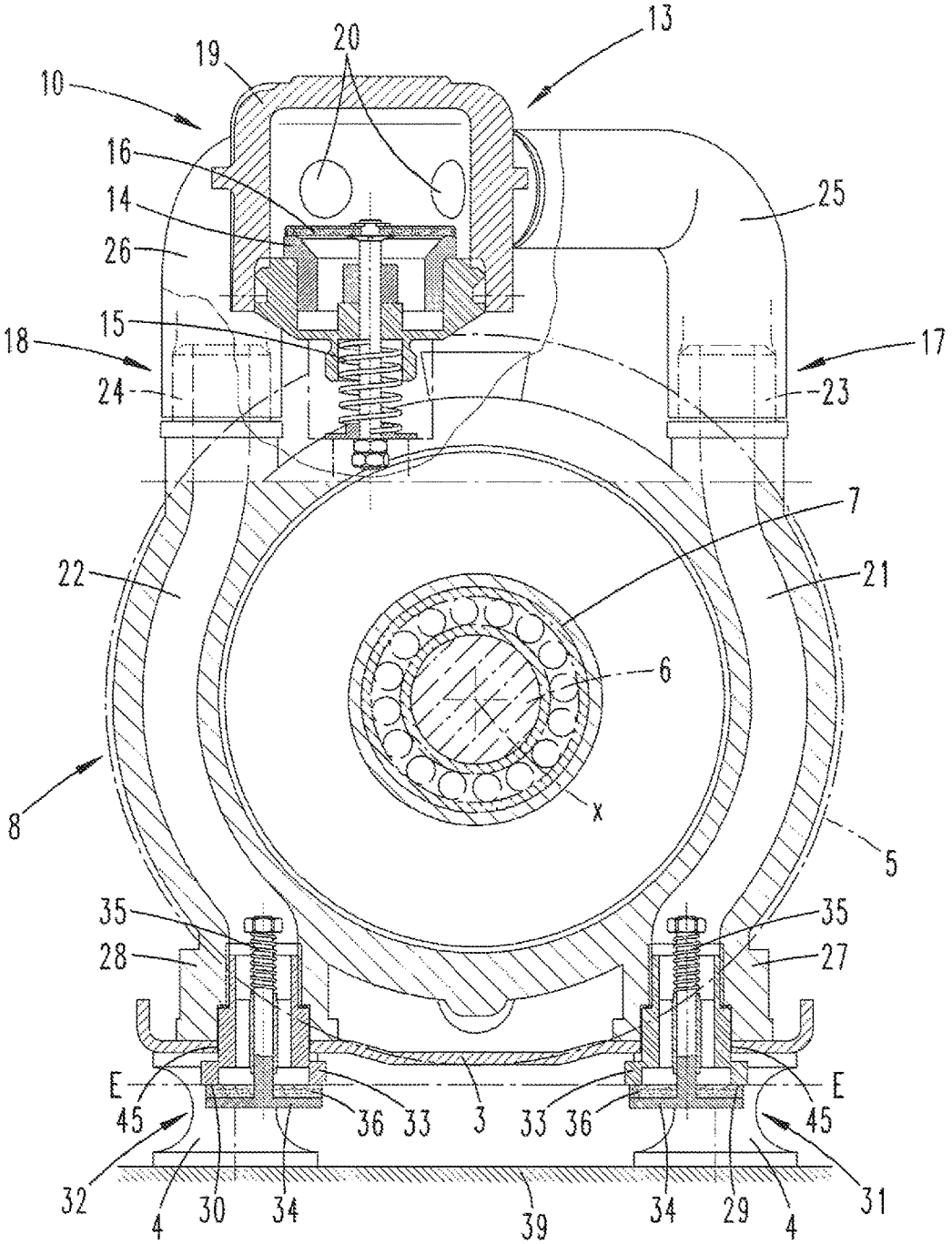
FIG. 9 shows a section corresponding to FIG. 5, in which the combination is arranged on the base plate.
Figure 10:
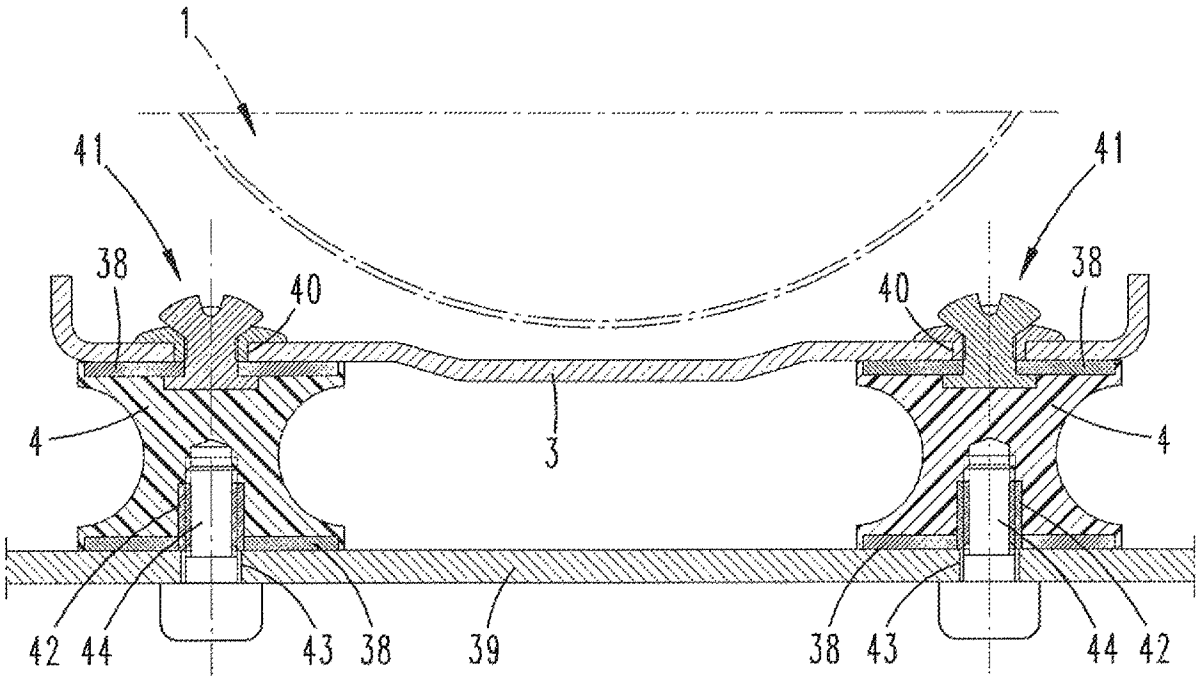
FIG. 10 shows the section X-X in FIG. 7.

The air discharge opening plane E resulting in the region of the valve seat 33 can preferably extend underneath the base plate 3 that carries the combination of motor 1 and vacuum pump 2 (see especially FIG. 9). For this purpose, the partial sections 21 and 22 on the flange side or their connecting pieces 27, 28 with the discharge valves 31, 32 respectively extend through correspondingly positioned passage openings 45 in the base plate 3 (see FIG. 9).

Figure 8:
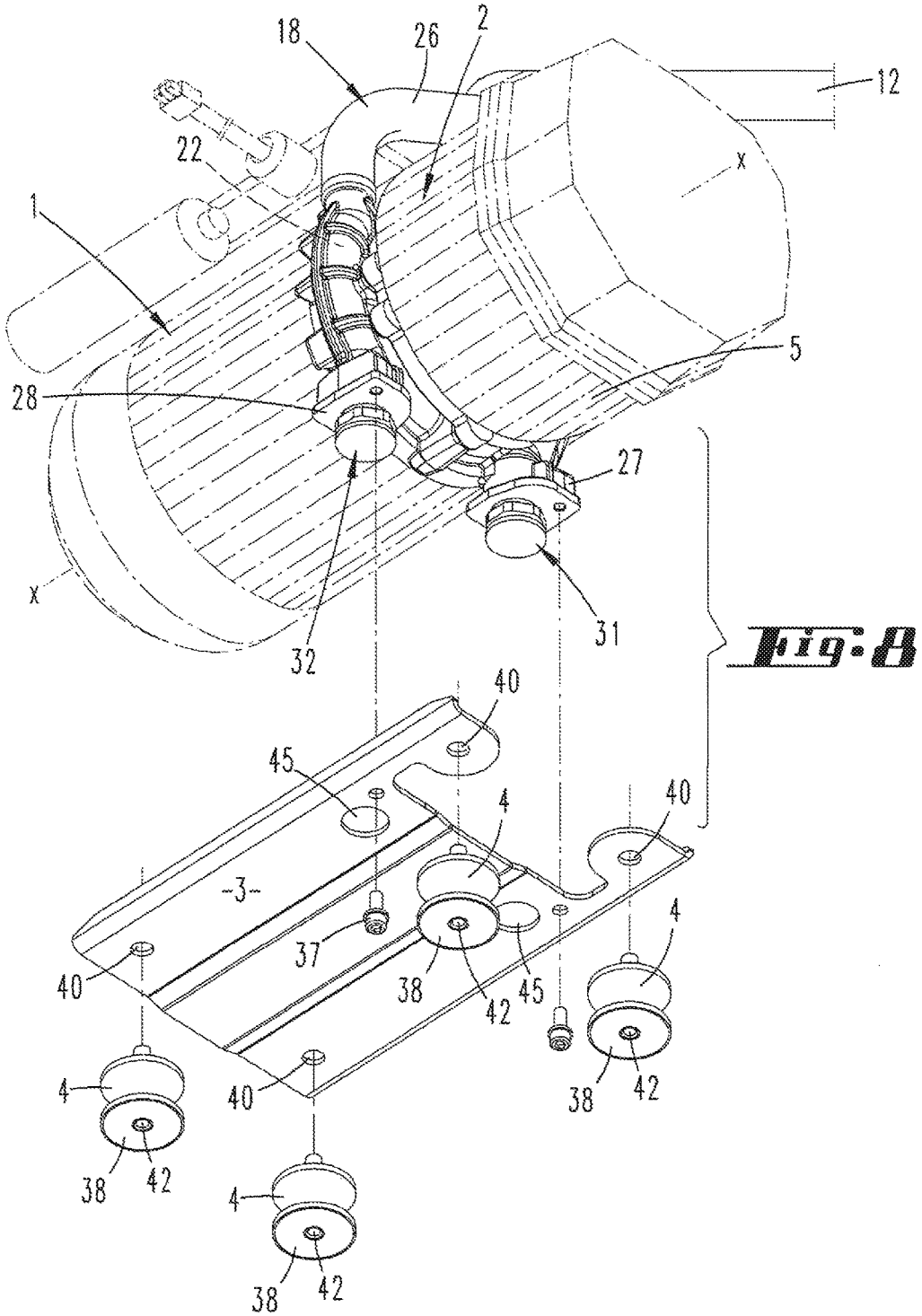
FIG. 8 shows a perspective exploded bottom view of the base plate, the legs and the motor flange, in which the motor and the vacuum pump are illustrated with dot-dash lines.

The base plate 3 may consist, e.g., of a formed sheet steel component. The combination is mounted thereon, particularly by means of screws. For this purpose, only a screw joint in the region of the connecting pieces 27 and 28 on the motor flange side may be provided as shown (see FIG. 8). The corresponding screws are identified by the reference symbol 37.

The motor 1 and the vacuum pump 2 are mounted on the motor flange 8 such that a stable combination of motor 1 and vacuum pump 2 is achieved. Due to the support of the entire combination on the base plate 3 by means of the motor flange 8, the motor 1 and the vacuum pump 2 may extend at a (vertical) distance from the facing surface of the base plate 3.

The base plate 3 realized, if applicable, in the form of a sheet metal component is supported on a surface such as, e.g., a floor 39 by means of the legs 4. The figures show an arrangement of four legs 4 in the respective corner regions of the base plate 3, the horizontal projection of which otherwise has an elongate rectangular shape.

The legs 4 are vibration-cushioned. They essentially consist of an elastomer material or a rubber material. According to the figures, a solid rubber or a solid elastomer material is essentially provided, wherein each leg 4 has an altogether diabolo-shaped design with two parallel end faces that are vertically spaced apart from one another in the operating position and between which the material extends such that a constriction is formed.

A disk 38 of a hard material, e.g. of metal or hard plastic, may be respectively inserted in the region of the end faces as shown and encased with the elastomer or rubber material by means of injection molding.

In the preferred rotationally symmetrical design of a leg 4, each disk 38 is likewise realized circularly.

The support on the underside of the base plate 3 is realized by means of the end faces, particularly the disks 38, and the support on the ground 39, e.g. on the bottom of a movable frame or the like, is realized by means of the downwardly directed end face.

Each leg 4 is mounted on the base plate 3 in association with a mounting opening 40, preferably in a captive and operatively inseparable fashion. The figures show a mounting 41 in the form of a rivet joint.

The base plate 3 with the combination of motor 1 and vacuum pump 2 mounted thereon can be supported on the ground 39 in a vibration-cushioned fashion by means of the legs 4.

In this context, it is furthermore conceivable, for example, to mount this unit consisting of the combination and the base plate 3 with the legs 4 on the ground 39, wherein the bottom disk 38 of a leg 4 is for this purpose held in the leg 4 such that it extends through a threaded sleeve 42 and is encased with the elastomer or rubber material by means of injection molding in order to cooperate with a screw 44 that is screwed through the ground 39 from underneath in the region of bores 43.

All disclosed characteristics are essential to the invention (individually, but also in combinations with one another). The content of the associated/attached priority documents (copy of the priority application) is hereby fully incorporated into the disclosure of this application, namely also for the purpose of incorporating characteristics of these documents into claims of the present application. The characteristics of the dependent claims characterize independent inventive enhancements of the prior art, particularly for submitting divisional applications on the basis of these claims.

| List of Reference Symbols | |
|---|---|
| 1 | Motor |
| 2 | Vacuum pump |
| 3 | Base plate |
| 4 | Leg |
| 5 | Pump housing |
| 6 | Motor shaft |
| 7 | Opening |
| 8 | Motor flange |
| 9 | Air intake device |
| 10 | Air exhaust device |
| 11 | Connecting piece |
| 12 | Suction hose |
| 13 | Discharge valve |
| 14 | Valve seat |
| 15 | Spring |
| 16 | Valve disk |
| 17 | Pipe section |
| 18 | Pipe section |
| 19 | Valve cover |
| 20 | Discharge opening |
| 21 | Partial section |
| 22 | Partial section |
| 23 | Connecting piece |
| 24 | Connecting piece |
| 25 | Hose pipe |
| 26 | Hose pipe |
| 27 | Connecting piece |
| 28 | Connecting piece |
| 29 | Discharge opening into surroundings |
| 30 | Discharge opening into surroundings |
| 31 | Discharge valve |
| 31 | Discharge valve |
| 33 | Valve seat |
| 34 | Valve disk |

-continued

| List of Reference Symbols | |
|---|---|
| 35 | Spring |
| 36 | Sealing layer |
| 37 | Screw |
| 38 | Disk |
| 39 | Ground |
| 40 | Mounting opening |
| 41 | Mounting |
| 42 | Threaded sleeve |
| 43 | Bore |
| 44 | Screw |
| 45 | Passage opening |
| 52 | Pump shaft |
| 54 | Rotary vane |
| 56 | Coaxial rotor |
| 60 | Chamber housing |
| 62 | Rotary vane chamber |
| a | Arrow |
| x | Axis |
| E | Opening plane |

The invention claimed is:

1. A vacuum device for generating a vacuum, the vacuum device comprising:

a vacuum pump comprising:

a pump housing enclosing a pump shaft, an air intake device connected with the pump housing, and an air exhaust device connected with the pump housing, and a motor acting upon the pump shaft for driving the vacuum pump, wherein operation of the vacuum pump sucks in air via the air intake device for generating the vacuum, wherein operation of the vacuum pump discharges exhaust air via the air exhaust device, wherein the air exhaust device comprises a discharge valve, wherein the exhaust air is, downstream of the discharge valve, divided into two partial flows that are respectively associated with a first pipe section and a second pipe section, wherein the discharge valve is arranged above the motor and the vacuum pump relative to a normal operating state of a combination of the motor and the vacuum pump, wherein the first pipe section conveys the exhaust air from a region above the motor and the vacuum pump into a region underneath the motor and the vacuum pump and is connected to the discharge valve, and wherein the first pipe section is partially or completely arranged within an outside contour of at least one of the motor and the vacuum pump relative to a cross section perpendicular to a longitudinal axis of at least one of the motor and the pump shaft.

2. The vacuum device according to claim 1, wherein the first pipe section comprises a discharge opening into surroundings, and wherein the discharge opening into the surroundings is provided with an additional discharge valve.

3. The vacuum device according to claim 1, wherein the motor comprises a motor flange, and wherein the first pipe section and the second pipe section are integrated into the motor flange.

4. The vacuum device according to claim 3, wherein the motor flange comprises a metallic material, and wherein the first pipe section and the second pipe section are formed by the metallic material of the motor flange.

5. The vacuum device according to claim 3, wherein the first pipe section integrated into the motor flange extends along a segment of a circle, and wherein a center of the circle is associated with a geometric axis of at least one of the motor and the pump shaft.

6. The vacuum device according to claim 1, wherein a combination of the motor and the vacuum pump is mounted on a base plate that is supported by legs, and wherein a discharge opening of the first pipe section leads into surroundings underneath the base plate relative to a normal operating state of the combination.

7. The vacuum device according to claim 6, wherein the base plate is supported by vibration cushioned legs.

8. The vacuum device according to claim 7, wherein at least one of the vibration-cushioned legs comprises an elastomer or rubber part.

9. The vacuum device according to claim 1, wherein the vacuum pump is a rotary vane vacuum pump.

10. A vacuum device for generating a vacuum, the vacuum device comprising:

a vacuum pump comprising:

a pump housing enclosing a pump shaft, an air intake device connected with the pump housing, and an air exhaust device connected with the pump housing, and a motor acting upon the pump shaft for driving the vacuum pump, wherein operation of the vacuum pump sucks in air via the air intake device for generating the vacuum, wherein operation of the vacuum pump discharges exhaust air via the air exhaust device, wherein the air exhaust device comprises a discharge valve and a pipe section, and wherein the discharge valve is arranged above the motor and the vacuum pump relative to a normal operating state of a combination of the motor and the vacuum pump, wherein the pipe section conveys the exhaust air from a region above the motor and the vacuum pump into a region underneath the motor and the vacuum pump and is connected to the discharge valve, and wherein the pipe section is partially or completely arranged within an outside contour of at least one of the motor and the vacuum pump relative to a cross section perpendicular to a longitudinal axis of at least one of the motor and the pump shaft.

11. The vacuum device according to claim 10, wherein the vacuum pump is a rotary vane vacuum pump.

* * * * *